US005417095A

United States Patent [19]

Francia

[11] Patent Number: 5,417,095

[45] Date of Patent: May 23, 1995

[54] THREAD ROLLING ATTACHMENT AND METHOD

[75] Inventor: Paul P. Francia, Rochester, N.Y.

[73] Assignee: C.J. Winter Machine Works, Inc., Rochester, N.Y.

[21] Appl. No.: 148,293

[22] Filed: Nov. 8, 1993

[51] Int. Cl.[6] ..... B21H 3/04

[52] U.S. Cl. ..... 72/84; 72/103

[58] Field of Search ..... 72/84, 98, 102, 103, 72/104, 118, 703

[56] References Cited

U.S. PATENT DOCUMENTS

| | | | |
|---|---|---|---|
| 2,011,761 | 8/1935 | Handel | 72/104 |
| 2,666,348 | 1/1954 | Trishman | 72/103 |
| 3,648,502 | 3/1972 | Klug et al. | 72/98 |
| 3,972,212 | 8/1976 | Brinkman | 72/102 |
| 4,050,276 | 9/1977 | Habegger | 72/104 |
| 4,706,483 | 11/1987 | Perraudin | 72/84 |

*Primary Examiner*—Lowell A. Larson
*Attorney, Agent, or Firm*—Shlesinger Fitzsimmons Shlesinger

[57] ABSTRACT

One end of a rotating workpiece is threaded by using a single threading roll having on one end thereof a plurality of annular threading ribs the diameters and/or pitches of which increase slightly and progressively from one end of the plurality to the other. Initially the roll is advanced diagonally toward the end of the work to be threaded until all of the threading ribs on the roll have penetrated the work only part way to the final depth of the desired thread, after which the roll is advanced parallel to the axis of the work for a predetermined distance. The tool is then retracted and the foregoing threading operation is repeated several times, but with the tool holder being advanced a slightly greater radial distance toward the work with each successive threading operation until the desired thread depth has been achieved.

12 Claims, 3 Drawing Sheets

THREAD ROLLING ATTACHMENT AND METHOD

BACKGROUND OF THE INVENTION

This invention relates to threading apparatus, and the like, and more particularly to an improved thread roll attachment therefor, and a novel method of rolling threads onto bar stock and the like.

Heretofore a variety of methods have been employed to form threads on the end of cylindrical or tubular bar stock, or the like. One of the most basic ways, of course, is to utilize a lathe of the type in which a sharp tool point is fed perpendicularly to the work axis in order to cut a thread into the work. An alternative way of forming threads on the periphery of a workpiece is to utilize thread rolling apparatus of the type disclosed, for example in U.S. Pat. Nos. 2,345,871 and 4,766,750. These two patents teach the use of threading rolls, which have formed on their outer peripheral surfaces annular, generally V-shaped ribs that are urged under considerable pressure into rolling engagement of the outer peripheral surface of a piece of rotating bar stock. The ribs thus form threads on the bar stock by plastically deforming and displacing portions of the metal engaged by the thread rolling ribs.

Because of the excess amount of pressure which must be applied to the peripheral surface of a workpiece in order to "roll" a thread into the surface of a workpiece, it has been customary heretofore to use a plurality of threading rolls for effecting thread formation. For example, as disclosed in the above-noted U.S. Pat. No. 2,345,871, threads are formed on the outer peripheral surface of a tubular workpiece by expanding one end of the bore in the workpiece radially outwardly and into engagement with three threading rolls. The rolls are rotatably mounted in a surrounding head mechanism for rotation about parallel axes which are equiangularly spaced 180° about the axis of rotation of the workpiece. Thus, during thread formation the periphery of the workpiece is engaged simultaneously at three, equiangularly spaced points about its axis by the three threading rolls. In the case of the above U.S. Pat. No. 4,766,750, threads are rolled onto the outer peripheral surface of a solid, cylindrical piece of bar stock by two threading rolls, which simultaneously are introduced radially into engagement with diametrally opposite sides of a rotating workpiece so that neither one roll nor the other tends to create a moment of force transversely of the axis of the rotating workpiece.

Accordingly, because of the extreme radial pressure which usually is applied to a rotating workpiece during the thread rolling of threads thereon, it has been customary in the past to utilize a plurality of thread rolls which engage the workpiece at equiangularly points about its axis of rotation. In that way, the axial centerline of the workpiece is stabilized during the thread rolling operation —i.e. it is not subject to any excess moment forces extending transverse to its axis. However, the use of plural rollers adds to the overall expense of the equipment, not only because of the cost of the rollers, but also because of the need for developing equipment which will accurately and simultaneously engage and disengage the threading rolls with the workpiece during a thread forming operation.

The present invention, however, provides a more simplified and less expensive method of rolling threads onto a workpiece by using a single thread roller to perform the same function heretofore performed by a plurality of such thread rolls. Although U.S. Pat. No. 3,877,273 teaches that single forming rolls have been utilized in the past for the cold rolling of gear teeth in a disc-shaped gear blank, there was no need or concern for balancing the radial pressure applied to the periphery of the gear blank, since the blank was of an axial length no greater than the axial length of the gear rolling tool. Also, as shown by U.S. Pat. No. 4,706,483, a single finishing or burnishing roll has been utilized to burnish a helical thread previously formed on a workpiece, but the radial pressure exerted by the burnishing wheel is minimal compared to that necessary for a thread rolling operation. In addition, as disclosed in U.S. Pat. No. 3,972,212, it heretofore has been customary to employ single knurling tool or roll for applying a knurled surface to the outer periphery of a rotating workpiece, but again, the forming pressure applied by the knurling roll to the work is insignificant as compared to the pressures heretofore normally applied by threading rolls to a workpiece.

SUMMARY OF THE INVENTION

The present invention has for a primary purpose the elimination of the need for employing a plurality of threading rolls for forming the threads on the periphery on a piece of rotating bar stock. More particularly, the invention is particularly suited for use with CNC equipment of the type which utilizes a software controlled tool support, which is capable of manipulating a threading roll of the type described hereinafter in a rapid, and extremely simple manner. To produce this desired result, the invention utilizes in a preferred embodiment thereof a single, rotatably mounted threading roll which has formed on its outer peripheral surface two or more threading ribs which are generally V-shaped in cross section, and which are repeatedly engaged and disengaged with the rotating stock during the formation thereon of either external or internal threads. With each successive operation the threading roll is adjusted slightly radially of the axis of the rotating workpiece in order to increase the depth of the resulting thread with each successive passage of the thread roll in an axial direction. Although this single point threading requires several, successive rolling operations in order to complete a thread on the workpiece, nevertheless, in so doing, the radial pressure applied by the threading roll to the workpiece is substantially less than that which would be applied by prior art threading rolls of the type described above. In each of the hereinafter described embodiments, the respective threading roll is rotatably mounted in one end of a tool holder which is designed for quick-change in conventional CNC equipment. In each such tool holder the associated thread roll is mounted so that during a thread rolling operation its axis of rotation will be inclined to the axis of rotation of the workpiece to form a helical thread thereon. In one of the following embodiments the threading tool is designed to permit ready adjustment of the axis of rotation of the threading roll to secure the desired helix angle during a threading operation.

DETAILED DESCRIPTION OF THE PREFERRED EMBODIMENTS

Figure 3:
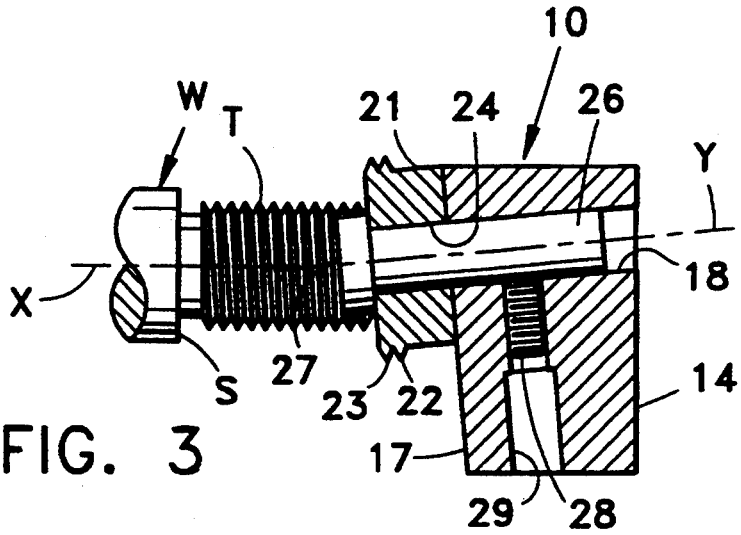
FIG. 3 is a fragmentary sectional view taken along the line 3—3 in FIG. 2 looking in the direction of the arrows.

Referring now to the drawings by numerals of reference, and first to FIGS. 1 to 3, 10 denotes generally a tool holder having an elongate shank portion 12, which is generally rectangular in cross section, and a slightly larger head portion 14, which also is nearly rectangular in configuration. Shank portion 12 of tool holder 10 is adapted to be removably secured in a movable, tool manipulating support 16, a portion of which is shown fragmentarily in FIGS. 1 and 2. The head portion 14 of tool 10 is not perfectly rectangular in cross section, because one sidewall thereof, wall 17 as shown in FIG. 3, lies in a plane which is inclined slightly to the vertical, and to the remaining three sidewalls of the head portion 14, when the tool 10 is mounted in the support 16 as shown in the drawings. Also, head portion 14 has therethrough a circular bore 18, which opens at one end on the face of the inclined sidewall 17, and which has an axial centerline Y that extends at right angles to the wall 17, and which is inclined slightly to the horizontal when a thread is being formed as noted in greater detail hereinafter.

Mounted on the head portion 14 of tool 10 for rotation coaxially of the bore axis Y, and adjacent the face of the inclined sidewall 17 of the holder 10, is an annular threading roll 21. Formed on the end of roll 21 remote from wall 17 (the upper end in FIG. 1 and the left end in FIG. 3) are two, integral, circumferential thread-rolling ribs 22 and 23, each of which has an outer peripheral surface which is generally V-shaped in cross section. Thread roll 21 has therethrough an axial bore 24 (FIG. 3), by means of which roll 21 is mounted for rotation on a pin 26. Pin 26 is secured at one end (the right end in FIG. 3) coaxially in the bore 18 of the head portion 14 of the tool holder 10, and has on its opposite end an enlarged-diameter head 27 which overlies or overlaps the end of the thread roll 21 upon which the ribs 22 and 23 are formed. Pin 26 is releasably secured in the bore 18 by a set screw 28, which is threaded into a bore 29 in the underside of the head portion 14 of the tool holder 10 to have its inner end engage the pin 26 removably to secure the latter against movement in the bore 18. As shown more clearly in FIG. 1, the threading ribs 22 and 23 of the roll 21 project slightly beyond head portion 14, and are mounted in axially spaced relation to the inclined sidewall 17 of the head portion 14 of the tool holder. And as shown in FIG. 3, ribs 22 and 23 are mounted also to rotate on pin 26 coaxially of the axis Y of bore 18.

In use, tool 10 is positioned by support 16 adjacent one end of a workpiece W, such as a piece of bar stock or the like, which is secured in and projects from a machine spindle (not illustrated) for rotation about an axis X, which for purposes of illustration will be considered to be a horizontal axis. In the embodiment illustrated, the work W has a reduced-diameter, threaded end section T, which is formed as noted hereinafter by the thread roll 21, and which projects coaxially beyond a transverse, circumferential shoulder S which is formed on the work W adjacent the inner end of its threaded section T.

Figure 1:
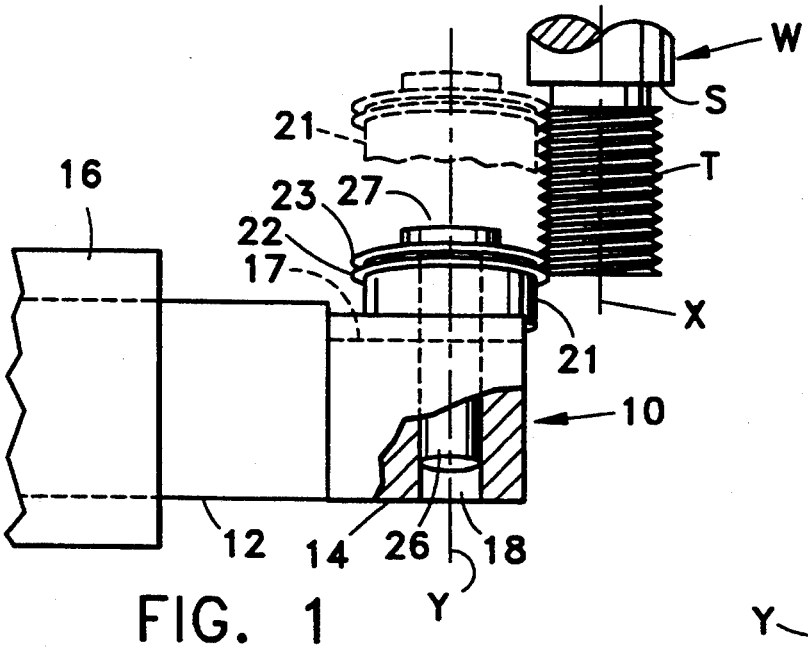
FIG. 1 is a fragmentary plan view of a thread rolling attachment made according to this invention, a portion thereof being shown in section, and its thread roll being shown in an operative position adjacent a workpiece which is being threaded.
Figure 1A:
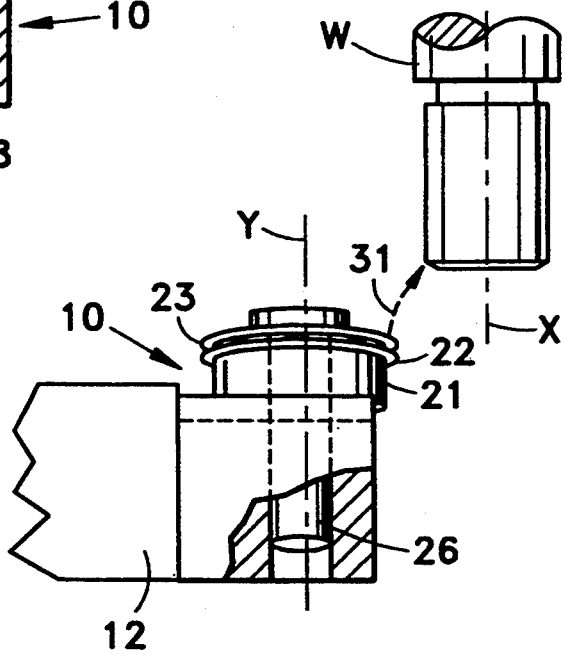
FIG. 1A is a view similar to FIG. 1 but showing the threading roll as it approaches its operative position.
Figure 2:
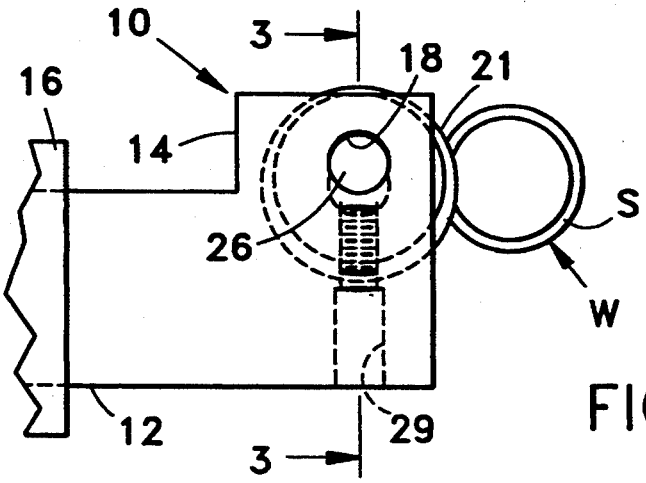
FIG. 2 is a fragmentary front elevation view of this attachment in its operative position.

To form the threads on the work W, and assuming at the outset that the portion of the work to be threaded is being rotated coaxially of the axis X as shown in FIG. 1A, the support 16 advances the tool holder 10 and thread roller 21 radially inwardly and axially of the work along a diagonal path indicated by the broken line 31 in FIG. 1A, and until the crests of ribs 22 and 23 have ramped onto and penetrated the outer peripheral surface of the work. At this stage roll 21 and-its threading ribs will have reached their operative positions, as represented for example by the position of roll 21 as shown by full lines in FIG. 1. Also at this time, the X and Y axes lie in parallel planes, but with the axis Y of the thread roll 21 being inclined slightly relative to the horizontal axis X as shown in FIG. 3.

After roll 21 has reached its operative position, further radial movement of support 16 ceases, but it continues to shift the tool holder 10 axially of the work W toward its shoulder S, thus moving roller 21 from its solid line position in FIG. 1 to its position as shown in phantom by broken lines in FIG. 1. During this axial movement of the roller the rotation of the work W will be imparted to the roller 21, and the ribs 22 and 23 will penetrate into the revolving, outer peripheral surface of the work W only part way to the final depth of the desired thread. During this movement, since the axis of the roller 21 is inclined slightly as shown in FIG. 3, a corresponding helical path will be imparted to the threads T which are formed in the work W.

Also as noted in FIG. 1, since the threading ribs 22 and 23 are formed on the end of the thread roll 21 remote from the tool arm 10, is it possible to advance the threading ribs 22 and 23 axially along the work until the threading ribs are positioned closely adjacent to the shoulder S, thus permitting the thread roll 21 to form threads T on the work W to a point immediately adjacent to the shoulder S. When the thread roll 21 has reached its innermost position as shown in broken lines in FIG. 1, the support 16 withdraws the tool support 10, and hence the thread roll 21 radially from the work W and returns the tool holder downwardly in FIG. 1, or to the right in FIG. 3 parallel to axis Y, and until the thread roll 21 is once again positioned adjacent to the terminal end of the work W. Thereafter the support 10 indexes the tool holder 10 slightly radially inwardly a little further than the first time, so that the thread forming rolls 22 and 23, when next advanced from their solid to their broken line positions in FIG. 1, will penetrate the work W a little further, thereby cold working the work W to a slightly greater depth. This procedure is repeated a number of times until the threads T have reached the desired depth, at which time the threading of the work W will have been completed.

Figure 4:
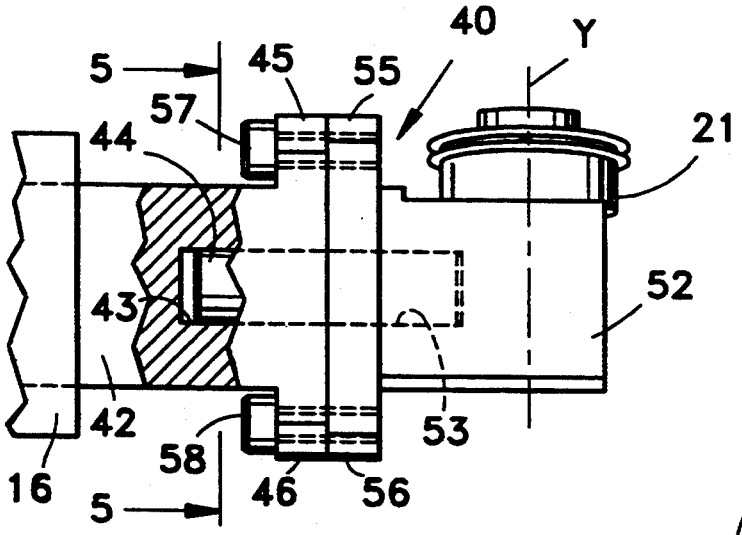
FIG. 4 is a fragmentary plan view generally similar to FIG. 1, but showing a modified attachment.
Figure 5:
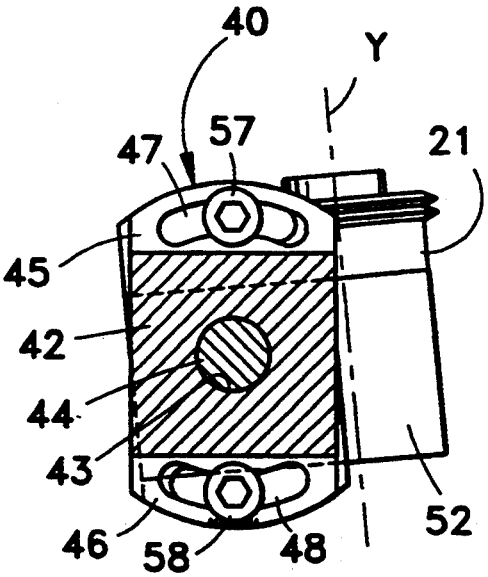
FIG. 5 is a sectional view taken along the line 5—5 in FIG. 4 looking in the direction of the arrows.

Referring now to FIGS. 4 and 5, wherein like numerals are employed to denote elements similar to those employed in the first embodiment, 40 denotes generally a modified tool holder comprising an elongate, rectangular shank portion 42, which is releasably secured at one end in the machine support 16 in a manner similar to that in which the shank 12 is secured in support 16 in the first embodiment. In its opposite end shank portion 42 has therein an axial blind bore 43, in which is seated one end of a cylindrical centering pin 44. Also at the end thereof remote from support 16 the shank portion 42 has projecting from opposite sides thereof a pair of integral wing flanges 45 and 46 having therethrough elongate, arcuate slots 47 and 48, respectively, which are disposed coaxially of the blind bore 43.

Adjustably attached to the end of the shank portion 42 remote from support 16 is an elongate, generally rectangularly shaped head portion 52, which in the end thereof adjacent to the shank portion 42 has an axial blind bore 53 in which is seated the opposite end of the centering pin 44. At the end thereof adjacent the shank portion 42 the head portion 52 also has projecting from opposite sides thereof a pair integral wing flanges 55 and 56, which register with the flanges 45 and 46, respectively, on the shank portion 42. Locking bolts 57 and 58 have reduced-diameter shank sections which extend slidably through the arcuate slots 47 and 48 in flanges 45 and 46, respectively, and which are threaded at their inner ends into registering, internally threaded openings formed in the flanges 55 and 56, respectively. Screws 57 and 58 have enlarged-diameter heads which overlie the outer faces of the flanges as 45 and 46, so that when the screws 57 and 58 are threaded snuggly into the flanges 55 and 56, the head section 52 is secured against rotation relative to the shank section 42 of the holder. On the other hand, when the screws 57 and 58 are backed off slightly, the entire head section 52 can be rotated slightly in opposite directions about the axis of the centering pin 44 to the extent permitted by the arcuate slots 47 and 48 in flanges 45 and 46.

Removably mounted on the head section 52 of the holder 40 in a manner similar in which it is mounted in the head section 14 of the first embodiment, is a cylindrical threading roll 21, which is similar to that of the first embodiment. As in the first embodiment, threading roll 21 is mounted to rotate about an axis Y which is inclined slightly to the horizontal (see FIG. 5) when the holder 40 is mounted in the support 16 as shown in the drawing. In the embodiment shown in FIGS. 1–3, the inclination of the axis of rotation of the thread roller 21 depends upon the location of the axis of the bore 18 in the head section 14. In the embodiment shown in FIGS. 4 and 5, however the head section 52 is adjustable about the axis of pin 44, so that notwithstanding the fact that the thread roller 21 is mounted for rotation about a predetermined axis relative to the head portion 52 of the holder 40, nevertheless the head portion 52 can be adjusted either to increase or decrease, selectively, the angle of inclination of the axis Y relative to the horizontal, thereby selectively to increase or decrease the helix angle of the threads formed on the work W by roll 21 of the second embodiment.

Figure 6:
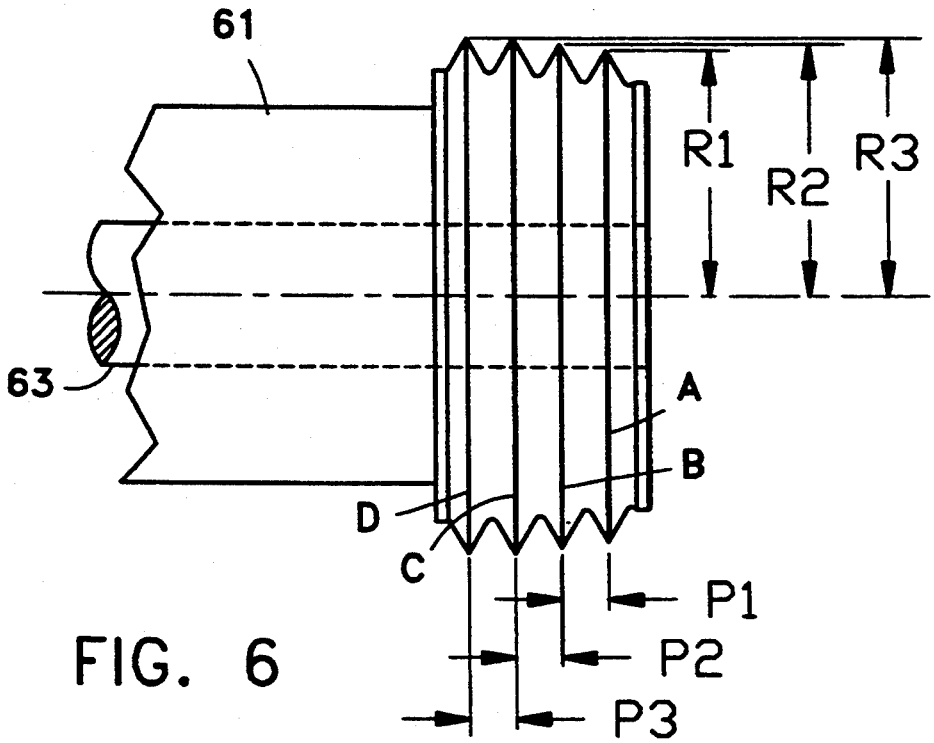
FIG. 6 is an enlarged side elevation view of a modified form of a thread roll which is suitable for practicing this invention.

Although in the embodiments shown in FIGS. 1 to 5 the thread roller 21 has been shown as having only two thread-rolling ribs 22 and 23, it will be apparent to one skilled in the art that the exact number of such threading ribs is a matter of choice. For example, FIG. 6 is a fragmentary side view of modified threading roll 61 which has formed on one end thereof four, annular thread-forming ribs A, B, C and D, each of which, as in the case of the preceding embodiments, is formed with a generally V-shaped crest. Roller 61 also has therethrough an axial bore 63 for mounting the roll on a tool holder in a manner similar to that shown in the preceding embodiments. When using threading rolls 21 or 61 for forming threads in the manner taught by this invention, it has been found to be particularly advantageous to use on the roller a progressive, modified pitch, and/or a progressive form depth in order to achieve a more desirable management of material flow in the work which is being threaded.

For example, as shown in FIG. 6, P1, P2 and P3 represent the respective pitch distances between adjacent pairs of threading ribs A and B, B and C, and C and D, respectively. It is desirable that these pitch distances increase slightly with each successive pair of adjacent threading ribs, commencing with the leading threading rib A. For example, assuming that it is desired to roll into a workpiece (not illustrated in FIG. 6) a thread having a pitch of 0.0625" the pitch between leading thread rolling ribs AB and BC will be slightly less than the desired pitch of 0.0625". For example, P1 could be on the order of 0.0620", P2 could be on the order of 0.0622", and finally the pitch P3 would be the standard or desired pitch of 0.0625". Also, to provide a progressive form depth, the depth to which the respective ribs penetrate the work during one threading operation would be slightly different, with the leading rib A, for example, not penetrating quite as far as the successive ribs. Referring to FIG. 6, R1 represents the radial distance from the centerline of rib A to its crest, R2 represents the radial distance from the centerline of rib B to its crest, and R3 represents the radial distance from the centerline of ribs C and D to their respective crests. It will be noted that these radial distances increase slightly for successive ribs A, B and C, the radial distance of D being the same as C. For example, the differences between RI and R2 could be on the order of 0.0010", with the same difference existing between R2 and R3, in which case rib B would penetrate the wore to a slightly great depth than rib A, while the two ribs C and D would each penetrate (equal distances) slightly greater than the rib B during a threading operation. Obviously, these differences between the pitches and depths to which the various ribs are designed to penetrate the work, can be varied slightly without departing from this invention.

From the foregoing it will be apparent that the present invention provides a relatively simple and inexpensive means for rolling threads onto a workpiece even in the most restricted areas. A particular advantage of the present invention is that the threading ribs of rolls 21 and 61 are located on the end of the thread roll which projects away from the tool holder, so that it is possible to form threads on the free end of work W right up to a point immediately adjacent to an enlarged-diameter or transverse shoulder the type denoted at S in FIGS. 1 to 3. This contrasts with prior thread rolling attachments of the type in which a plurality of thread rolls must be engaged simultaneously with the work in order to apply equal radial pressure to the work at equally spaced points about its axis.

Figure 7:
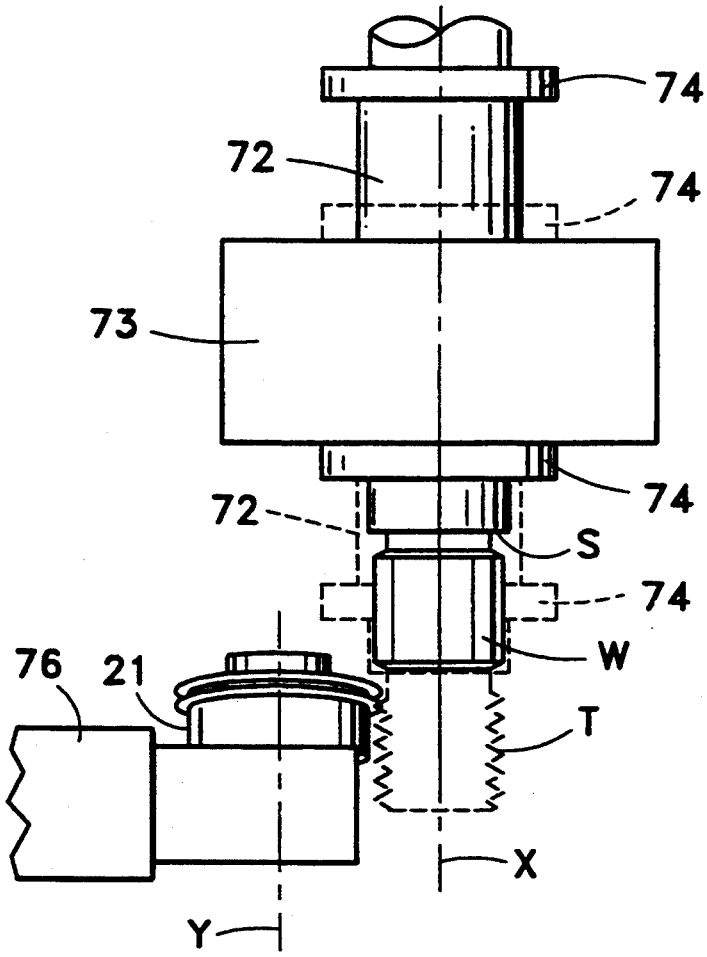
FIG. 7 is a fragmentary plan of the attachment of FIG. 1 when used with a special work supporting spindle.

This also makes the threading attachment suitable for use with conventional work supporting equipment of the type shown in FIG. 7. In this embodiment the workpiece W is mounted adjacent one end thereof in a cylindrical housing 72 that is rotatably mounted in a machine frame support 73 for limited axial movement coaxially of the work axis X. Housing 72 has thereon a pair of axially spaced annular shoulders 74 which are engagable with opposite sides, respectively of support 73 to limit axial movement of housing 72, and hence the work W along axis X.

In use, the threading roll 21 is mounted in a carrier 76 which moves the roll 21 radially inwardly to the position shown in FIG. 7, wherein its threading ribs barely overlap the end of work W that is to be threaded. Housing 72 and the work W are then advanced slightly axially toward the roll 21, or vice versa, until the threading ribs engage the work W, which is now being rotated by means that form no part of this invention. At this time the carrier 76 is held stationary, and the housing 72 is permitted to travel from its solid line to its broken line in FIG. 7, such axial movement being imparted to housing 72 (and hence work W) by virtue of the rolling engagement of work W with the threading ribs of roll 21, which as in the embodiment of FIGS. 1 to 3 has its axis Y inclined slightly to the axis X of the work. Thus the very formation of the helical threads T in the portion of work W being threaded, causes the work and housing 72 to be shifted axially relative to the frame support 73. As in the preceding embodiments, this threading operation is repeated until the work W has been threaded as desired.

By adopting the thread rolling attachments as disclosed herein for use in connection with CNC-type equipment, and/or the equipment of FIG. 7, it is possible to use a single threading roll to perform a threading operation simply by repeating the threading operation a number of times, and with each successive threading operation, causing the threading roll to penetrate into the work to a slightly greater depth with each-successive threading operation, until the desired threading depth has been achieved. In addition, such incremental penetration of the work, and management of material flow in the work during a threading operation is considerably enhanced by providing each threading roll with a progressive modified pitch, and or progressive forming depth (progressive increase in rib diameters). Also, depending upon the type of material being threaded, it has been found that by advancing the threading roll diagonally until all of its threading ribs have been ramped into operative engagement with the end of the work that is to be threaded, excessive penetration by the leading threading ribs is obviated.

While this invention has been illustrated and described in connection with a tool holder shank which is generally rectangular and cross section, it would be apparent to one skilled in the art that the exact configuration of the shank can be changed without departing from this invention: for example, by employing a circular shank with a flat or keyway thereon for securing the shank against rotation in the support 16. Moreover, the thread rolling can be effected on bore walls to form threads internally of a workpiece. In addition, while in the embodiment shown in FIG. 1A the threading roll is advanced into engagement with the work W along the diagonal path 31, it is possible in certain cases to advance the roll radially into engagement wit the work before commencing movement thereof axially of the work. Also, while this invention has illustrated and described in detail in connection with only certain embodiments thereof, it would be apparent that it is capable of still further modification, and that this application is intended to cover any such modifications as it may fall within the scope of one skilled in the art or the appended claims.

I claim:

1. In a threading apparatus of the type including a spindle for rotating a workpiece having thereon a cylindrical surface that is to be threaded, and a tool support movable radially and axially of said cylindrical surface on a workpiece that is rotated by said spindle, an improved thread rolling attachment, comprising an annular threading roll having a plurality of integral, axially spaced, circumferential thread-rolling ribs formed on and protecting coaxially from the outer peripheral surface of said roll adjacent one end thereof, an elongage tool holder, means for removably mounting said roll adjacent the opposite end thereof on said tool holder adjacent one end thereof, and for rotation about an axis extending transversely of said tool holder, and whereby said roll projects at said one end thereof beyond one side of said holder, and means for removably mounting the opposite end of said tool holder on said tool support to be supported thereby in an operative position in which the axis of rotation of said threading roll is disposed in a first plane parallel to and spaced from a second plane containing the axis of rotation of said cylindrical surface on said workpiece, and is inclined slightly to said axis of rotation of said cylindrical surface.

2. In the apparatus as defined in claim 1, wherein said means mounting said roll on said tool holder comprises, a pin removably secured at one end thereof coaxially in a circular bore extending transversely through said tool holder adjacent said one end thereof, said pin projecting at its opposite end axially beyond said one side of said tool holder, and said roll being mounted to rotate on said opposite end of said pin coaxially thereof adjacent said one side of said tool holder, and with said opposite end of said roll confronting said one side of said holder, whereby said ribs are axially spaced from said one side of said tool holder.

3. In the apparatus as defined in claim 2, including means mounting said pin on said tool holder for limited rotational adjustment in said first plane about the longitudinal centerline of said tool holder, thereby to adjust the angle of inclination of the axis of rotation of said threading roll relative to the axis of rotation of said cylindrical surface on said workpiece.

4. In the apparatus as defined in claim 2, wherein said bore in said one end of said tool holder extends normal to the longitudinal centerline of said tool holder, and said one end of said tool holder is mounted on said opposite end of said holder for limited adjustment relative thereto about the longitudinal centerline of said holder, thereby selectively to adjust the angle of inclination of the axis of said threading roll relative to the axis of rotation of said cylindrical surface on said workpiece.

5. In the apparatus as defined in claim 1, wherein the diameters of at least certain of successive thread-rolling ribs on said threading roll increase slightly progressing from one end of said plurality of ribs to the other.

6. In the apparatus as defined in claim 1, wherein the pitches between adjacent thread-rolling ribs of each pair of at least certain of successive pairs thereof on said threading roll increase slightly progressing from one end of said plurality of ribs to the other.

7. A method of using a single threading roll for rolling onto a peripheral surface of a rotating workpiece a plurality of threads of predetermined thread depth and pitch, comprising forming coaxially on one end of a cylindrical threading roll a plurality of axially spaced, circumferential thread-rolling ribs, mounting said roll adjacent its opposite end on a tool carrier for rotation on said carrier coaxially of the axis of said roll, and so that said roll projects at said one end thereof beyond one side of said carrier with registering, circumferential portions of said ribs projecting beyond said tool carrier, performing a threading operation by moving said carrier to advance said roll toward said workpiece from a retracted position to an operative position in which the axis of said roll is inclined to the axis of rotation of said workpiece, and said circumferential portions of said ribs penetrate said peripheral surface of said workpiece only part way to the desired thread depth, then moving at least one of said workpiece and said roll respectively, relative to the other, and parallel to the axis of rotation of said workpiece until a predetermined number of helical threads have been formed in said peripheral surface of said workpiece by said ribs, and then moving said roll back to its retracted position, and repeatedly performing said threading operation, including advancing said threading roll slightly further toward said workpiece with each successive threading operation until a thread of the desired depth has been formed on said peripheral surface of said workpiece.

8. A method as defined in claim 7, including forming said plurality of thread-rolling ribs on said roll so that the diameters thereof increase slightly progressing from one end of said plurality of ribs to the other.

9. A method as defined in claim 7, including forming said plurality of thread-rolling ribs on said roll so that the pitches between adjacent ribs of each pair of at least certain successive pairs thereof on said roll increase slightly progressing from one end of said plurality of ribs to the other.

10. A method as defined in claim 7, including moving said carrier so that during the advance of said roll toward said workpiece, said roll advances simultaneously radially and axially of said workpiece along a path extending diagonally of the axis of said workpiece.

11. A method as defined in claim 7, including moving said roll relative to said workpiece in a direction parallel to the axis of said workpiece during formation of said helical threads on said workpiece.

12. A method as defined in claim 7, including moving said workpiece relative to said roll in a direction parallel to the axis of said workpiece during formation of said helical threads on said workpiece.

* * * * *